United States Patent [19]

Ray et al.

[11] Patent Number: 4,492,557

[45] Date of Patent: Jan. 8, 1985

[54] FILAMENT QUENCHING APPARATUS

[75] Inventors: Valton O. Ray, Irmo; Robert H. Roeland, Columbia, both of S.C.; Carl H. Potter, Richmond, Va.; Yehuda I. Szmuilowicz, Columbia, S.C.

[73] Assignee: Allied Corporation, Morris Township, Morris County, N.J.

[21] Appl. No.: 515,096

[22] Filed: Jul. 19, 1983

[51] Int. Cl.[3] ..... B29C 25/00

[52] U.S. Cl. ..... 425/72 S; 264/176 F; 264/237

[58] Field of Search ..... 264/237, 176 F; 425/72 S

[56] References Cited

U.S. PATENT DOCUMENTS

| | | | |
|---|---|---|---|
| 2,273,105 | 2/1942 | Heckert | 425/72 S |
| 3,070,839 | 1/1963 | Thompson | 425/72 S |
| 3,274,644 | 9/1966 | Massey et al. | 425/72 S |
| 3,320,343 | 5/1967 | Buschmann et al. | 425/72 S |
| 3,358,326 | 12/1967 | Nommensen et al. | 425/72 S |
| 3,619,452 | 11/1971 | Harrison et al. | 425/72 S |
| 3,834,847 | 9/1974 | Fletcher | 425/72 S |
| 3,999,910 | 12/1976 | Pendlebury et al. | 425/72 S |
| 4,285,646 | 8/1981 | Waite | 425/72 S |
| 4,332,764 | 6/1982 | Brayford et al. | 425/72 S |

FOREIGN PATENT DOCUMENTS

| | | | |
|---|---|---|---|
| 48-23492 | 7/1973 | Japan | 264/103 |
| 998664 | 7/1965 | United Kingdom | 264/176 F |

*Primary Examiner*—Jay H. Woo
*Assistant Examiner*—J. Fortenberry

[57] ABSTRACT

Apparatus for quenching a melt extruded filament is provided. The apparatus features a quenching chamber and plenum chamber separated from one another by a diffuser which comprises a layer of foam with at least two areas of differing porosity. A varied gas distribution pattern into the quenching chamber can be achieved through use of the apparatus.

12 Claims, 4 Drawing Figures

FILAMENT QUENCHING APPARATUS

BACKGROUND OF THE INVENTION

Field of the Invention

This invention relates to an apparatus for the production of a substantially non-turbulent stream of cooling gas for quenching one or more synthetic filaments produced by a melt-spinning process.

In a typical melt-spinning process, one or more filaments is extruded from one or more spinnerettes and passed into a quenching chamber. A diffuser separates the quenching chamber from an adjoining plenum chamber which is in communication with the cooling gas supply system. The synthetic polymer extruding from the spinnerette is a viscous liquid at an elevated temperature. Cooling of this liquid takes place in the quenching chamber where a cooling gas, which is usually air, is contacted with the filaments. The cooling gas enters the quenching chamber from the plenum chamber through the diffuser. The function of the diffuser is to reduce cooling gas turbulence in the quenching chamber where the turbulence can detract from uniformity of the filaments.

Faster yarn speeds coupled with decreased distances between spun filaments to increase yield causes undesirable crowding of the filaments, frequently with interfilament collisions, in the quenching zone. As a consequence, improving the stability of the threadline and improving yarn uniformity are very important. Control of the quench fluid flow rate and more uniform distribution of the quench fluid in the quenching chamber are necessary.

The diffuser has been the primary means of reducing turbulence in the cooling gas stream. There are a variety of diffusers in the prior art; these include screens, porous foam, perforated metal plates, sintered metal, metallic wool, felt and sandwiches of mesh screens. U.S. Pat. Nos. 3,834,847 to Fletcher and 3,619,452 to Harrison, both of which are hereby incorporated by reference, teach use of a porous foam diffuser; the former patent also teaches the layering of foam on a restrictor plate to permit attainment of varying gas distribution patterns in the plenum chamber. Other patents which show use of foam diffusers include U.S. Pat. Nos. 4,285,646 to Waite and 4,332,764 to Brayford et al., both of which are hereby incorporated by reference.

Quench systems which allow different cooling gas rates to be supplied to varying sections of the quenching chamber are also known. See U.S. Pat. Nos. 3,999,910 to Pendlebury et al., 3,274,644 to Massey et al., and 2,273,105 to Heckert, all of which are hereby incorporated by reference. A honeycombed flow rectifier system is shown in U. S. Pat. No. 3,320,343 to Buschmann et al., hereby incorporated by reference.

The present invention has been developed to improve quench fluid penetration of a filament bundle for an increased number of filaments.

SUMMARY OF THE INVENTION

A varied gas distribution pattern into the quenching chamber can be achieved through use of the quenching apparatus of the present invention. The apparatus comprises a quenching chamber through which the filament can pass and a plenum chamber having a gas entry opening and being separated from the quenching chamber by a diffuser, the diffuser comprising a layer of foam of at least two areas of differing porosity.

In a preferred embodiment the diffuser comprises a layer of foam having a first area and a second area approximately equal in size and corresponding to passage of the filament through the quenching chamber, the first area having a lower porosity than the second area. The layer of foam abuts a honeycomb sheet located immediately upstream of and coextensive with the layer of foam. The diffuser is slanted at an angle of up to 10 degrees, most preferably about 3 degrees, from the vertical at its base. Gas supply means is connected to the gas entry opening, and two perforated dispersion plates, separated by an air gap, are disposed across the gas supply means immediately upstream of the gas entry opening.

By porosity is meant average number of pores per inch. Porosity is determined according to the air pressure drop test set forth in Military Specification MIL-B-83054B (U.S.A.F.), dated May 17, 1978, and amended Oct. 22, 1981, hereby incorporated by reference. The test is as follows. The pore size determination shall be by the air pressure drop technique specified herein. One specimen for each sample shall be run for all but qualification. For qualification, three specimens shall be tested. The cylindrical specimen shall be 10 inches in diameter by one ±0.02 inch thick, where the one-inch dimension is in the height direction of the test section. For production and lot testing, the porosity test specimen shall be taken within the top three inches of the test section. For qualification testing, the three specimens shall be taken from the same location but from the upper, middle and lower portions of the bun height. Pressure drop measurements shall be made using a porosity test jig which has been properly calibrated. Calibration shall be conducted on a daily basis using a special pressure drop screen in order to determine the reference setting for the orifice differential manometer. Prior to sample testing, both manometers shall be adjusted to zero with no air flow. The specimen shall then be inserted into the sample holder until it is properly seated into the cutout. The blower shall be started and the air flow set to coincide with the daily reference calibration setting on the orifice differential manometer. Next read the sample pressure drop (uncorrected) to the nearest 0.005 inch on the 4-inch manometer (designated sample differential). The value shall then be corrected for thickness (if other than 1.00 inch thickness) by dividing it by the measured sample thickness. This corrected air pressure drop shall then be compared to the porosity curve (FIG. 1) in order to determine the average pore size for the sample specimen. The sample pressure drop and average pore size shall be reported. Note: the porosity values shown on FIG. 1 are assigned and do not necessarily relate directly to the actual number of pores per lineal inch. For details on the porosity test jig see Scott Paper Company Drawing YH 102-067X54, equivalent, hereby incorporated by reference.

DESCRIPTION OF THE PREFERRED EMBODIMENT

Figure 1:
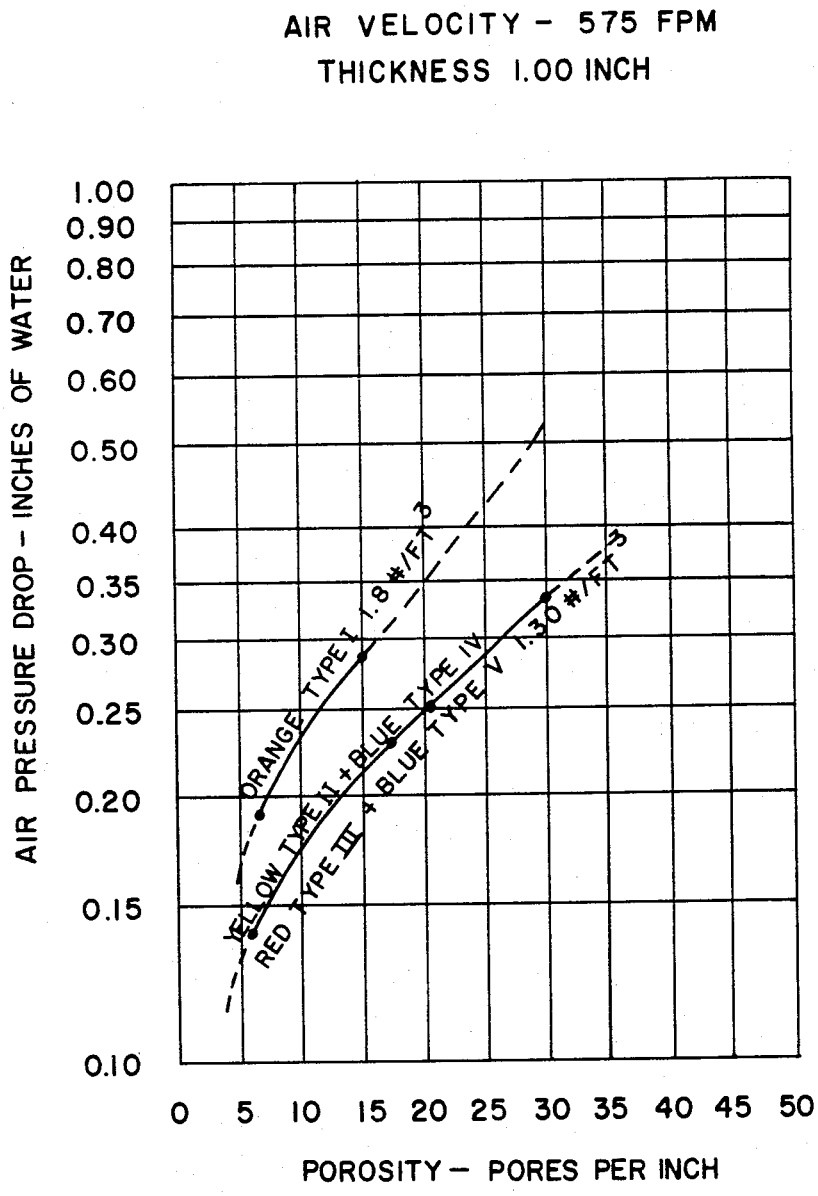
FIG. 1 depicts the porosity curve.
Figure 2:
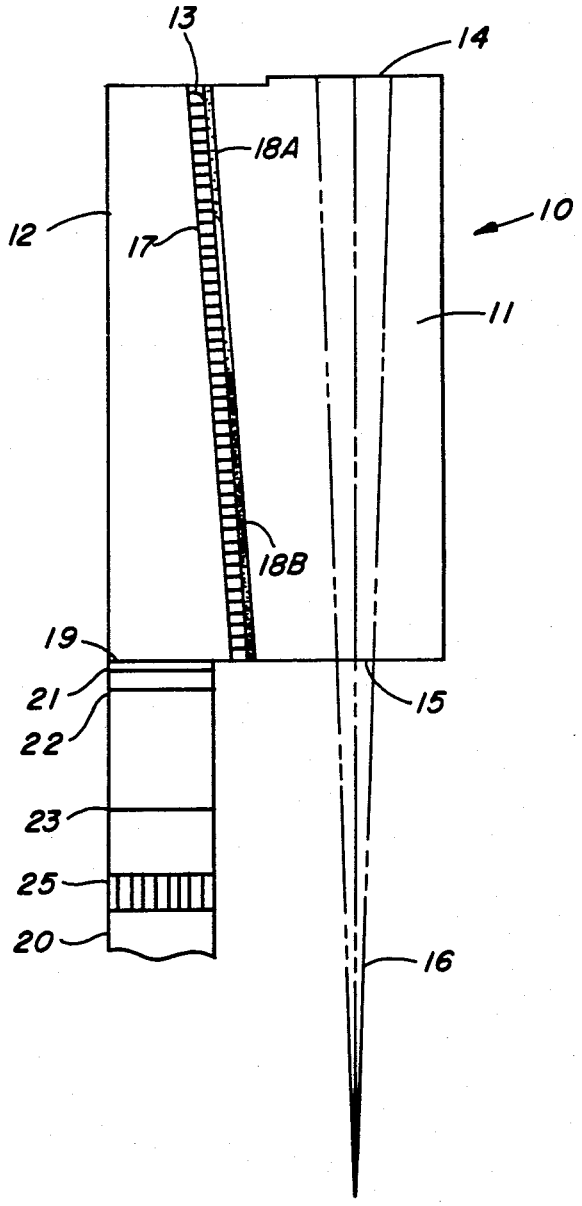
FIG. 2 is a side elevational section of the present invention.

With reference to FIG. 2, which depicts the quench system of the present invention, numeral 10 designates an elongated chimney which is substantially rectangular in cross-section. Quenching chamber 11 is separated from plenum chamber 12 by diffuser 13 and has an inlet 14 and outlet 15 for passage of filament bundle 16 substantially vertically therethrough. Filament bundle 16 is extruded from a spinnerette plate (unshown) into quenching chamber 11, exits therefrom either for collection on some takeup means (not shown) or for further process treatment. To the rear of elongated chimney 10, in the floor of plenum chamber 12, is located gas entry opening 19 to which gas supply means 20 delivers the gaseous cooling medium. Gas supply means 20 may be in the form of a conduit, and has a pair of perforated dispersion plates 21 and 22 disposed horizontally thereacross just prior to gas entry opening 19. Plate 21 is 0.0625 inch (0.1587 cm) thick and has 0.0625 inch (0.1587 cm) diameter holes to create an open area of about 14 percent. Approximately 1.5 inches (3.81 cm) upstream of plate 21 is plate 22 which is 0.0625 inch (0.1587 cm) thick with 0.1250 inch (0.3175 cm) diameter holes to create an open area of about 40 percent. A pair of butterfly valves (in parallel) 23 are disposed across gas supply means 20 upstream of plate 22 for control of the total gas flow rate. A honeycomb sheet 24, the cells of which are disposed in a vertical plane, is disposed across gas supply means 20 upstream of valves 23. Cooling gas enters plenum chamber 12 via gas supply means 20 and then passes through diffuser 13 into quenching chamber 11 in order to quench filament bundle 16.

Diffuser 13 is inclined at an angle of up to 10 degrees, preferably about 3 degrees, from the vertical at its base. Diffuser 13 comprises, in the direction of gas flow, honeycomb sheet 17, layer of foam 18 and wire screen (unshown). Honeycomb sheet 17 has, preferably, a 0.25 inch (0.64 cm) cell one inch (2.5 cm) thick. Alternately, a 0.13 inch (0.32 cm) cell 0.50 inch (1.3 cm) thick can be used. The axes of the cells are perpendicular to foam layer 18. Foam layer 18 comprises a first area 18A of 60 porosity foam 0.75 inch (1.9 cm) thick and a second area 18B of 100 porosity foam 0.55 inch (1.4 cm) thick. The foam utilized preferably is a polyurethane foam such as that made by Scott Foam Division of Scott Paper Company, Chester, PA. Foam areas 18A and 18B form, respectively, 48 and 52 percent of foam layer 18. Areas 18A and 18B are attached at their abutting edges with a contact adhesive such as Armstrong 520. Next downstream of foam layer 18 is a wire mesh screen [unshown, 0.50 inch×0.50 inch (1.3×1.3 cm)]; the screen serves a retentive function only.

Figure 3:
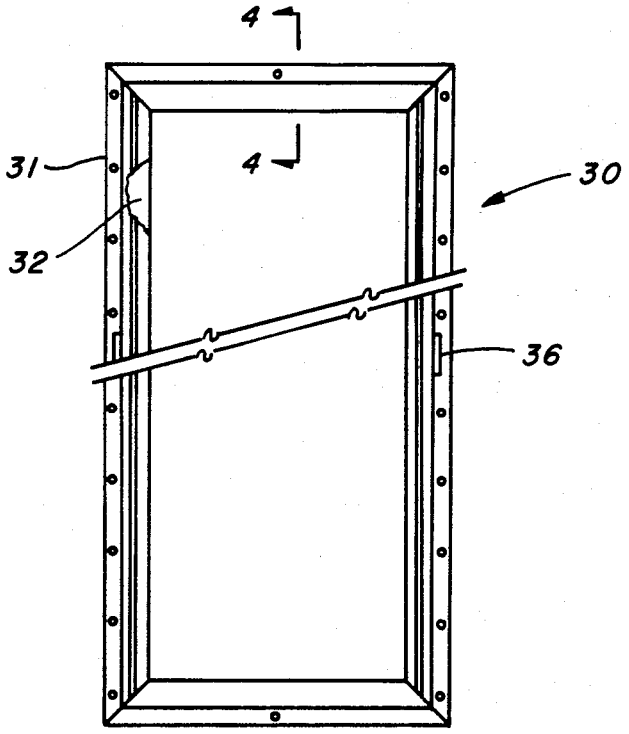
FIG. 3 is a front view of frame 30.
Figure 4:
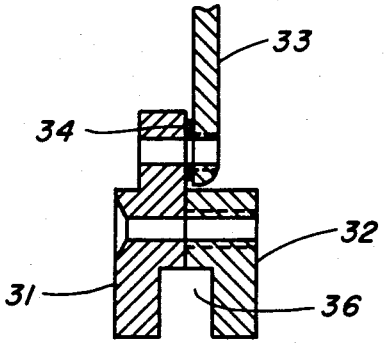
FIG. 4 is a view taken on line 4—4 of FIG. 3.

FIGS. 3 and 4 depict frame 30 for diffuser 13. Frame 30 comprises two halves 31 and 32 which are bolted together with the sandwich of honeycomb sheet 17, foam layer areas 18A and 18B, and wire mesh retaining screen in groove 35 formed thereby. Gasket 34 seals the edges of frame 30. Frame 30 can be bolted directly to the walls of plenum chamber 12 with pieces 31, or may have another piece 33 (FIG. 4) bolted thereto for use in attaching the diffuser to the walls of plenum chamber 12. Finger lifts 36 (see FIG. 3) are provided for ease of handling.

Means for dropping the pressure upstream of foam layer areas 18A and 18B may comprise a perforated plate, screens or possibly a thicker layer of foam in lieu of honeycomb sheet 17.

Slanting of the diffuser 13 causes a slight countercurrent flow of quench air. This permits better penetration of bundle 16 at existing flow velocities. The cooling gas profile is changed by changing the porosity of different areas of the foam layer 18. The door (right hand side of quench chamber 11 of FIG. 2) is a conventional slotted door having an open area of about 43 percent.

EXAMPLE 1

Cooling gas was supplied to the apparatus of the present invention (see FIGS. 2–4), and a velocity profile was measured at the foam layer 18 with a four-inch rotating vane anemometer (A547) made by Taylor Instrument Company. There were twenty-one (21) measurement points forming a 3×7 (horizontal×vertical) grid on the foam layer 18 which was 17.5 by 92 inches (44.5 by 234 cm). The first horizontal row of measurements was located (center line) 3.5 inches (8.9 cm) down, and the second and all subsequent rows an additional 12 inches (30 cm) down. The first vertical row was located (center line) 3 inches (8 cm) from the left, the second row was an additional 6 inches (15 cm) to the right thereof, and the third row was another 6 inches (15 cm) to the right. These twenty-one (21) measurements were averaged to give the average velocity in Table I. Foam areas 18A and 18B were of the same size and comprised 60 and 100 porosity foam, respectively. Nylon 6 filaments were melt extruded under pressure through a spinnerette having a plurality of symmetrical, Y-shaped orifices into quenching apparatus as depicted. The quenched filaments were lubricated and subsequently taken up.

EXAMPLE 2 (COMPARATIVE)

The procedure of Example 1 was repeated except that an unslanted (i.e., vertical) diffuser was utilized which comprised, in the direction of gas flow, a perforated plate with 0.03 inch (0.08 cm) hole diameters and approximately 20 percent open area, a layer of 100 porosity foam 0.75 inch (1.9 cm) thick, and a mesh screen, held together by an aluminum frame. The modification ratio of the yarn produced was lower than that of Example 1, which indicates less effective quenching of the filaments.

TABLE I

| Examples | Average Velocity (ft/min) | CFM[1] | Modification[2] Ratio |
|---|---|---|---|
| 1 | 110 | 1230 | 2.4[3] 3.3[4] 2.8[5] |
| 2 | 121[6] | 1353 | 2.1[3] 2.9[4] 2.6[5] |

[1]Average velocity multiplied by 11.18 $ft^2$/min.
[2]Average of 20 filament measurements, filaments being taken from different runs on the same position.
[3]Target 2.4 for 24 denier per filament (dpf) staple product.
[4]Target 3.1 for 15 dpf staple product.
[5]Target 3.0 for 15 dpf staple product.
[6]Lower than normal velocity.

EXAMPLE 3

The procedure of Example 1 was repeated except that three approximately equal foam areas of 45, 60 and 100 porosity foam were utilized with the 45 porosity foam at the top of diffuser 13 followed by the 60 porosity foam and then the 100 porosity foam. The benefits of Example 1 were also evident when using this diffuser.

We claim:

1. Apparatus for quenching a melt extruded filament, comprising (a) a quenching chamber through which said filament can pass;

(b) a plenum chamber, said plenum chamber having a gas entry opening and being separated from said quenching chamber by (c) a diffuser, said diffuser comprising a layer of foam with at least two areas of differing porosity; whereby a varied gas distribution pattern into the quenching chamber can be achieved.

2. The apparatus of claim 1 wherein said diffuser further comprises means for dropping pressure immediately upstream of said layer of foam.

3. The apparatus of claim 2 wherein said means for dropping pressure comprises a honeycomb sheet.

4. The apparatus of claim 3 wherein said layer of foam comprises a first area and a second area corresponding to the passage of said filament through the quenching chamber, said first area having a lower porosity than said second area.

5. The apparatus of claim 4 wherein said first area and said second area are approximately equal in size.

6. The apparatus of claim 4 wherein said diffuser is slanted away from said quenching chamber at an angle of up to 10 degrees from the vertical at its base.

7. The apparatus of claim 6 wherein said diffuser is slanted at an angle of about 3 degrees from the vertical at its base.

8. The apparatus of claim 6 wherein said apparatus further comprises gas supply means connected to said gas entry opening and at least one perforated plate disposed across said gas supply means immediately upstream of said gas entry opening.

9. The apparatus of claim 8 wherein there are two perforated plates disposed across said gas supply means immediately upstream of said gas entry opening, said plates being separated by an air gap.

10. The apparatus of claim 1 wherein said layer of foam comprises a first area and a second area corresponding to the passage of said filament through the quenching chamber, said first area having a lower porosity than said second area.

11. The apparatus of claim 1 wherein said layer of foam comprises a first area, a second area and a third area corresponding to the passage of said filament through the quenching chamber, said first area having a lower porosity than said second area which has a lower porosity than said third area.

12. Apparatus for quenching a melt extruded filament, comprising (a) a quenching chamber through which said filament can pass;

(b) a plenum chamber, said plenum chamber having a gas entry opening and being separated from said quenching chamber by (c) a diffuser, said diffuser comprising a layer of foam having a first area and a second area approximately equal in size and corresponding to passage of said filament through the quenching chamber, said first area having a lower porosity than said second area, a honeycomb sheet immediately upstream of and coextensive with said layer of foam, said layer of foam abutting said honeycomb sheet, said diffuser being slanted away from said quenching chamber at an angle of about 3 degrees from the vertical at its base;

(d) gas supply means connected to said gas entry opening; and (e) two perforated plates, separated by an air gap and disposed across said gas supply means immediately upstream of said gas entry opening.

* * * * *